US009080823B1

(12) United States Patent
Mantas

(10) Patent No.: US 9,080,823 B1
(45) Date of Patent: Jul. 14, 2015

(54) BUFFER ASSEMBLY

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 0 days.

(21) Appl. No.: 14/546,568

(22) Filed: Nov. 18, 2014

(51) Int. Cl.
*F41A 3/84* (2006.01)
*F41A 25/12* (2006.01)
*F41C 23/08* (2006.01)

(52) U.S. Cl.
CPC . *F41A 3/84* (2013.01); *F41A 25/12* (2013.01); *F41C 23/08* (2013.01)

(58) Field of Classification Search
CPC ..... F41C 23/06; F41C 23/08; F41A 25/10; F41A 25/12; F41A 3/84
USPC ..... 42/73, 74, 1.06; 89/44.01, 44.02
See application file for complete search history.

(56) References Cited

U.S. PATENT DOCUMENTS 3,366,011 A 1/1968 Sturtevant
5,909,002 A 6/1999 Atchisson
6,829,974 B1 * 12/2004 Gwinn, Jr. ..... 89/130
7,131,367 B1 * 11/2006 Boerschig et al. ..... 89/198
8,296,984 B2 10/2012 Kincel
2014/0075798 A1 3/2014 Kincel

FOREIGN PATENT DOCUMENTS

FR 1088428 * 3/1955

* cited by examiner

*Primary Examiner* — Stephen M Johnson
(74) *Attorney, Agent, or Firm* — Notaro, Michalos & Zaccaria P.C.

(57) ABSTRACT

A buffer assembly has a rod, a cap having a forward end against which a bolt carrier pushes during a firing cycle, the cap being movable along the rod, a shock absorbing plug attached to a rearward end of the rod for engaging an end wall of a receiver extension during an intermediate part of the firing cycle, a buffer tube moveable on the rod, a buffer spring engaged between the plug and the buffer tube for biasing the buffer tube toward a forward position, a counterweight mounted for movement on the rod, a shock absorbing washer between the counterweight and the cap for smoothing an impact between the counterweight and the cap at an end of the firing cycle, and a counterweight spring that is weaker than the buffer spring, for biasing the counterweight toward the cap.

20 Claims, 5 Drawing Sheets

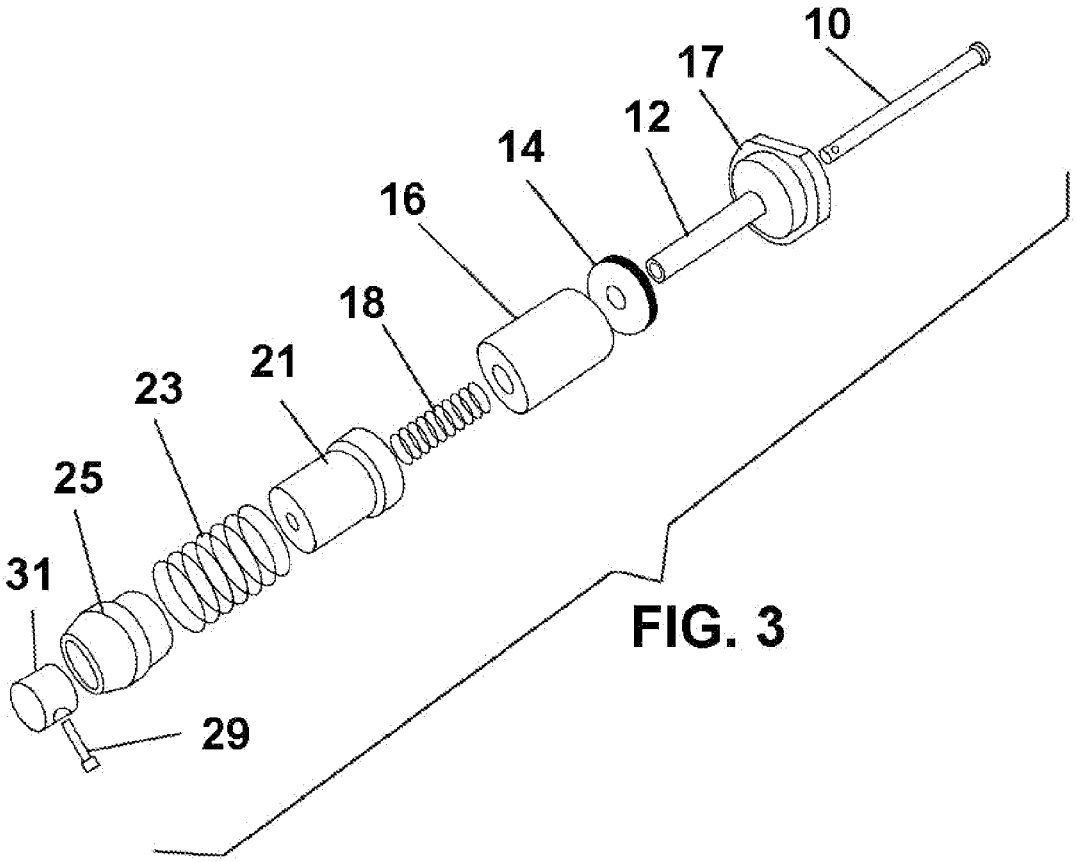
FIG. 3
FIG. 4
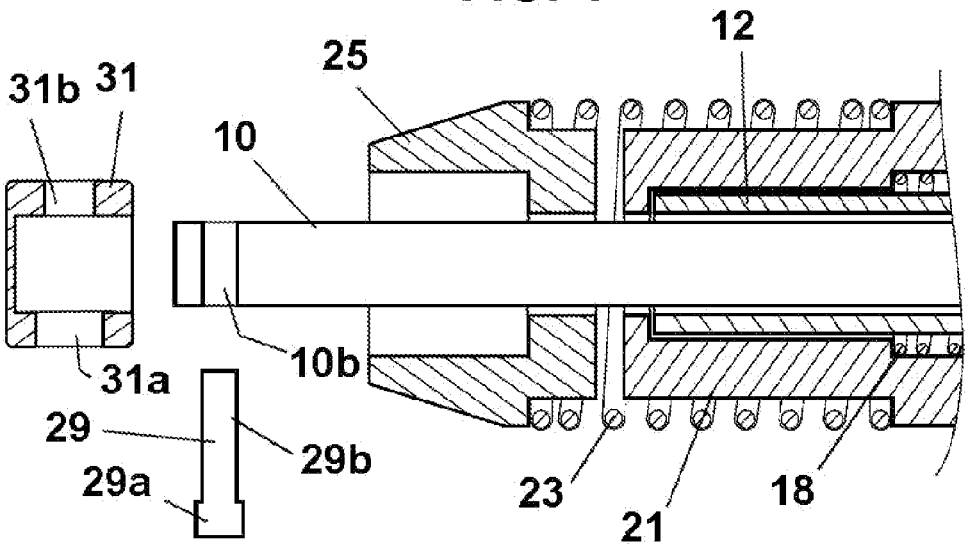

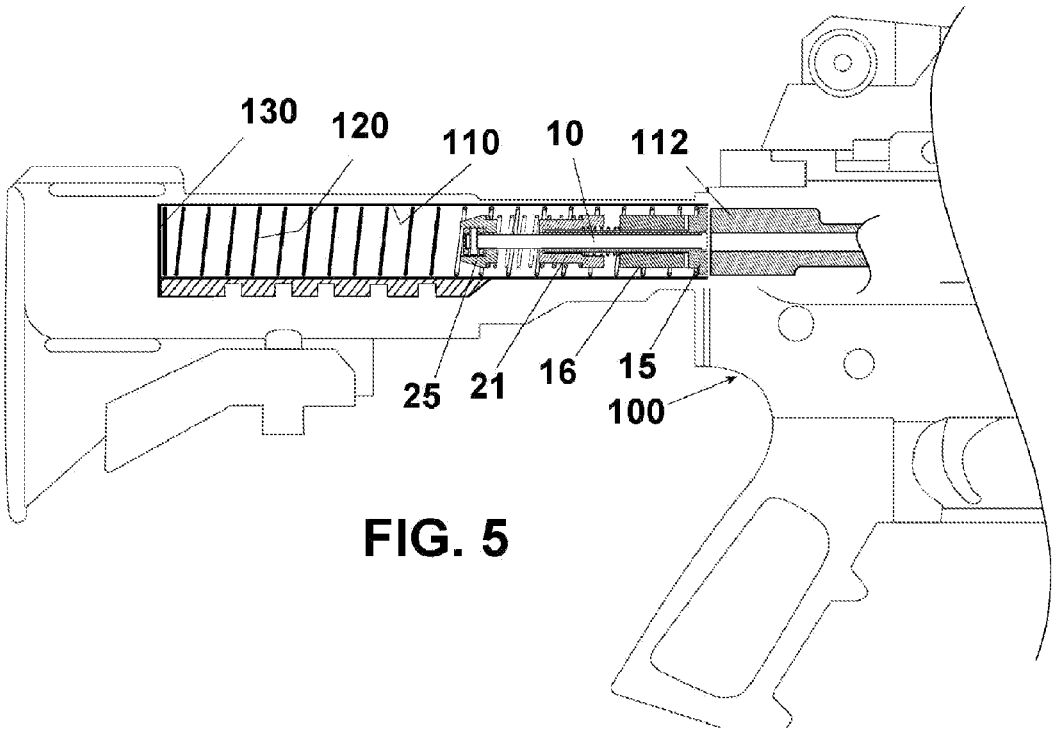
FIG. 5
FIG. 6
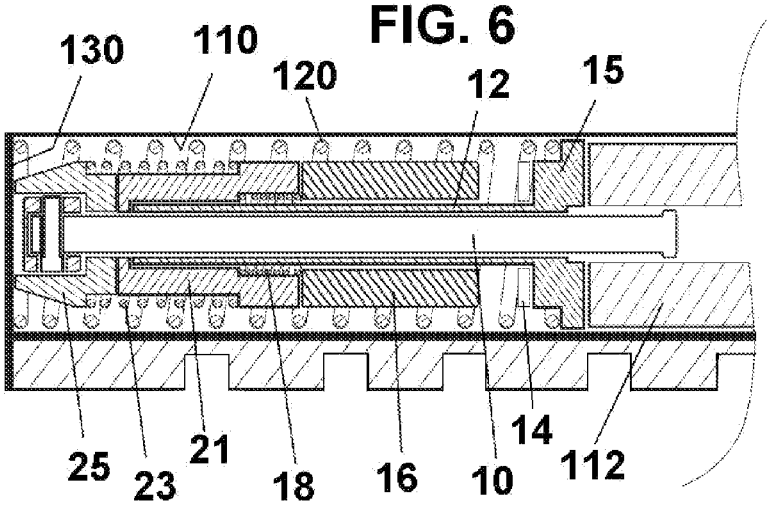

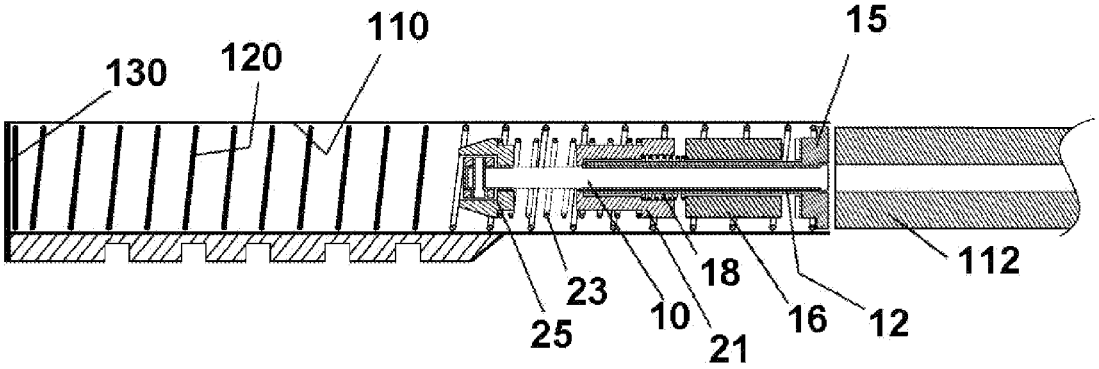
FIG. 9
FIG. 10
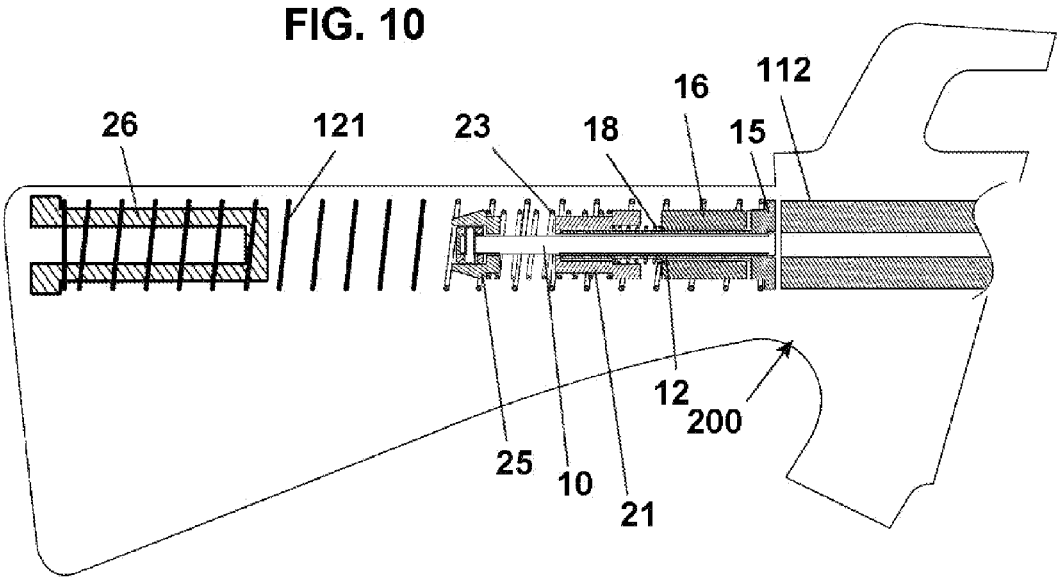

BUFFER ASSEMBLY

FIELD AND BACKGROUND OF THE INVENTION

The present invention relates generally to the field of firearms, and in particular to a new and useful buffer assembly for an automatic or semi-automatic rifle that delays the cycling rate and smoothes recoil of the rifle.

Controlling and ameliorating the adverse effects of recoil in an automatic carbine or rifle, has been an ongoing endeared for firearms designers since the creation of such weapons. Many of these efforts concentrate on improving a buffer assembly for such weapons.

U.S. Pat. No. 3,366,011 discloses a buffer assembly having a plurality of inertial masses acting in delayed sequence to oppose bolt rebound. The recoil assembly has a longitudinal cavity housing an elongated mass segmented into a plurality of coaxial weights spaced apart by washers having a low coefficient of restitution, the weights having a lost motion connection with each other and with the recoil assembly to apply their respective inertias in a delayed sequence to oppose rebound of the bolt assembly from its battery position.

U.S. Pat. No. 5,909,002 discloses a buffer assembly for use with firearms such as the M16 rifle, for reducing the cyclic rate of firing during full-automatic operation. The buffer assembly includes a unit to stop the bolt carrier at a desired full-recoil position, and a mass movable relative to that unit. When the bolt carrier stops at full-recoil, inertia causes the mass to continue moving rearwardly while further compressing the action spring. The action spring then returns that mass forwardly to contact the fixed portion of the buffer assembly, returning the bolt carrier to battery position. The bolt carrier remains at rest in recoil while the moveable weight slides rearwardly and then returns forwardly relative to the bolt carrier, thereby increasing the cycle time of firing and correspondingly reducing the cyclic rate of fire for the firearm.

U.S. Pat. No. 7,131,367 discloses a hydraulic bolt buffer for a firearm including a receiver having a longitudinal chamber, a bolt and carrier assembly mounted in the chamber for reciprocating movement between a recoil position and a battery position, a spring for urging the buffer into contact with the bolt and carrier assembly for movement therewith and for biasing the bolt and carrier assembly toward the battery position. Since a fluid tight seal is relied upon, any leak of this seal would compromise the performance of this buffer assembly.

U.S. Pat. No. 8,296,984 discloses a spring enhanced buffer for a firearm having a sleeve member having an open end and a closed end. A mass is contained within the sleeve member. This mass is chosen to meet the demands of the particular firearm. A bumper secures and seals the open end of said sleeve. A spring within the sleeve maintains the mass at a predetermined location when the buffer is in an at-rest position.

A need remains, however, for improving the buffer assembly of an automatic or semi-automatic firearm, with an effective, tunable, weather accommodating and long lasting buffer assembly that will function in a wide variety of shooting and weather conditions and that can be easily adjusted by a user for shooting conditions, preferences and styles.

SUMMARY OF THE INVENTION

It is an object of the present invention to provide an improved buffer assembly, in particular for an M16 or AR15 style firearm, that includes a mildly biased counterweight that delays the firing cycle time and smoothes the recoil of such weapons, and which can be fine-tuned for weather conditions, ammunition power and type, and shooter's preferences in a simple and effective manner.

Accordingly, another object of the invention is to provide a buffer assembly that comprises a rod having a forward end and a rearward end; a cap having a forward end against which a bolt carrier pushes during a firing cycle, the cap being movable along the rod between forward and rearward positions; a shock absorbing plug attached to a rearward end of the rod for engaging an end wall of a receiver extension during an intermediate part of the firing cycle; a buffer tube mounted for movement on the rod between a rearward position toward the plug during the intermediate part of the firing cycle, and a forward position spaced from the plug; a buffer spring engaged between the plug and the buffer tube for biasing the buffer tube toward its forward position; a counterweight mounted for movement on the rod, between a rearward position toward the buffer tube and a forward position toward the cap, for delaying the firing cycle; a shock absorbing washer between the counterweight and the cap for smoothing an impact between the counterweight and the cap at an end of the firing cycle; and a counterweight spring that is weaker than the buffer spring, for biasing the counterweight toward the cap.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter which preferred embodiments of the invention are illustrated.

BRIEF DESCRIPTION OF THE DRAWINGS

In the drawings:

FIG. 3 is an exploded perspective view of another embodiment of the improved buffer assembly of the present invention;

FIG. 4 is a partial sectional view of the rearward end of the buffer assembly of the present invention, illustrating how the assembly is easily dissembled for cleaning and for changing parts to tune its performance;

FIG. 5 is an axial sectional view of the buffer assembly of FIG. 1, in a battery position in the receiver extension of an automatic or a semi-automatic firearm, in particular, an M16 with an adjustable stock;

FIG. 6 is an axial sectional view of the buffer assembly of FIG. 1, in a full recoil position in the receiver extension of the M16, immediately after a shock absorbing plug of the buffer assembly has struck a rear wall of the receiver extension;

FIG. 9 is a view similar to FIG. 8, taken an instant after the position of FIG. 8 and just before the bolt carrier has fully returned to the battery position as depicted in FIG. 5, to illustrate an intermediate position of a counterweight of the buffer assembly, just before all parts of the buffer assembly return to their rest position; and FIG. 10 is a view similar to FIG. 5, of the buffer assembly of the invention in an M16 with fixed stock.

DESCRIPTION OF THE PREFERRED EMBODIMENTS

Figure 1:
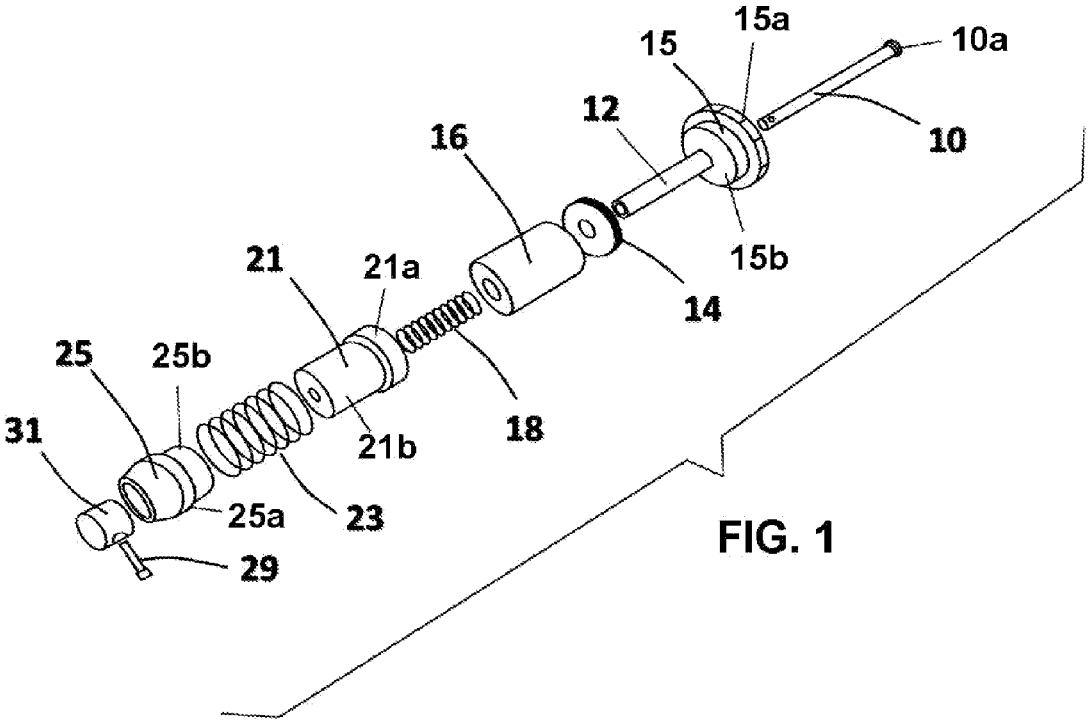
FIG. 1 is an exploded perspective view of an embodiment of the improved buffer assembly of the present invention.
Figure 2:
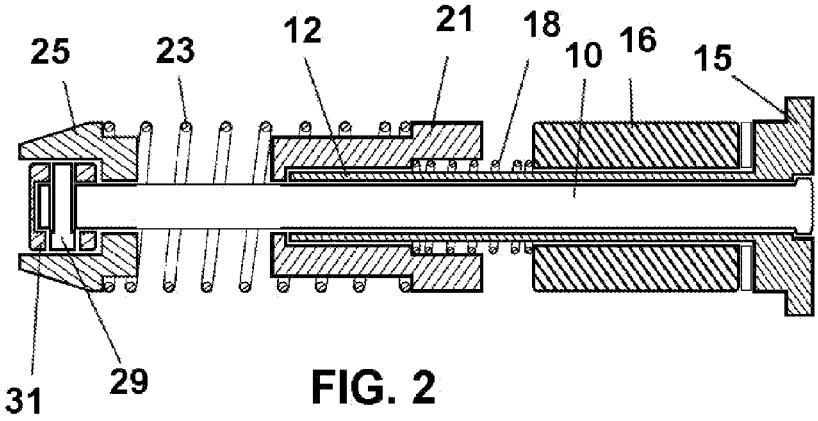
FIG. 2 is an axial sectional view of the buffer assembly of FIG. 1, in a rest position as it would appear in a battery position in the receiver extension of an automatic or a semi-automatic firearm before, the start of a firing cycle.

Referring now to the drawings, in which like reference numerals are used to refer to the same or similar elements, FIGS. 1, 2 and 5 illustrate a buffer assembly for moving in a receiver extension 110 of an automatic or semi-automatic firearm 100, particularly, but not exclusively, a Colt M16 or AR15. The buffer assembly moves against the bias of an action spring 120 in the receiver extension 110, from a forward battery position shown in FIGS. 5 and 10, to a rearward, fully recoil position shown in FIG. 6, by the action of a bolt carrier 112 movable at least partly into the receiver extension during the start of a firing cycle.

The buffer assembly includes a rod 10 having a forward large diameter end 10*a* and a rearward end and preferably make of strong solid material like steel. The buffer also includes a central tube 12 mounted for movement between a forward position and a rearward position on the rod, the central tube having a cap 15 at its forward end against which the bolt carrier 112 pushes during a firing cycle. The central tube 12 is shorter than the rod 10 so that the central tube may move along the rod between its forward and rearward positions. The large diameter end 10*a* of rod 10, sits in a likewise shaped and sized recess in the forward end of cap 15 to keep the parts of the buffer assembly from moving off the forward end of rod 10, as best shown in FIG. 2, while allowing the parts, including the cap 15, to move rearwardly on the rod. Tube 12 with its cap 15 are made of strong material such a steel.

A shock absorbing plug 25 is attached to a rearward end of the rod 10 for engaging an end wall 130 of the receiver extension 110 during an intermediate part of a firing cycle, namely the moment of full recoil during the cycle. Shock absorbing plug 25 is preferably made of resilient polymer or elastomer such a hard rubber that is long lasting and resilient in a wide range of temperature and weather conditions.

Figure 7:
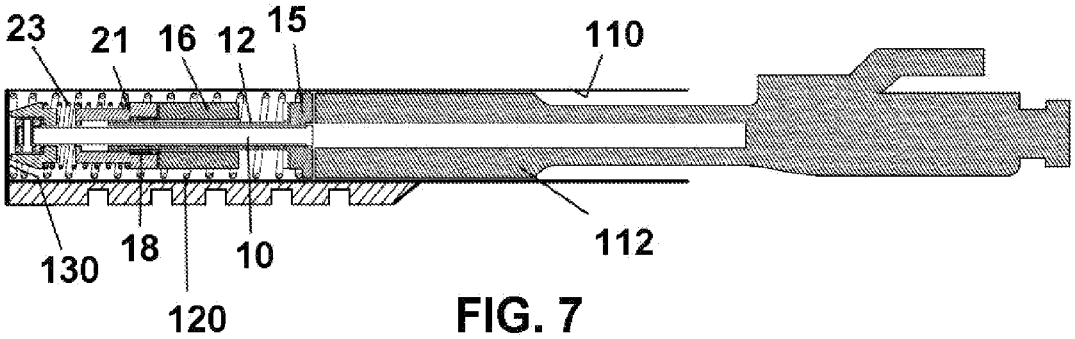
FIG. 7 is an axial sectional view of the buffer assembly of FIG. 1, during a firing cycle, shortly after the position illustrated in FIG. 6, as parts of the buffer assembly start to rebound as a bolt carrier of the M16 starts its return to the battery position.

A buffer tube 21 is mounted for movement with the central tube 12 and on the rod 10, between a rearward position with a rearward end of the buffer tube 21 near or against a forward face of the plug 25 during the intermediate part of the firing cycle, e.g. as shown in FIGS. 6 and 7, and a forward position spaced from the plug, during a rest or battery position for the buffer assembly, e.g. as shown in FIGS. 2 and 5. Buffer tube 21 is preferably made of rigid polymer, Aluminum, Titanium or other relatively light strong and rigid material.

A buffer spring 23 in the form of a compression coil spring, e.g. of spring steel, is engaged between the plug 25 and the buffer tube 21 for biasing the buffer tube toward its forward position.

A counterweight 16 is mounted for movement on the central tube 12, between a rearward position toward the buffer tube 21 and a forward position toward the cap 15. As will be explained in greater detail later in this disclosure, the counterweight 16 and how it is mounted and biased, is instrumental in delaying the firing cycle of the weapon, but works in concert with the other parts of the buffer assembly. Counterweight 16 is preferably made of metal such as iron carbide or other material that is heavier than the material of buffer tube 21, but that is sufficiently strong and weather and temperature resistant to survive many impacts during any number of firing cycles.

A shock absorbing washer 14 is mounted on the central tube 12 against the rearward face of the cap 15 and between the counterweight 16 and the cap 15, for smoothing an impact between the counterweight 16 against the cap at an end of each firing cycle. Washer 14 is preferably made of flexible, resilient material such a nylon or other polymer.

A counterweight spring 18 in the form of a compression coil spring preferably of spring steel, but that is smaller in diameter and weaker in compressive biasing force than the buffer spring 23, is mounted on the central tube 12, between buffer tube 21 and the counterweight 16, for biasing the counterweight toward the cap 15.

To hold the buffer assembly together in a way that can be easily disassembled, and with reference to FIGS. 1, 2 and 4, the shock absorbing plug 25 includes a rearward recess shaped and sized to receive a stopper 31 in the recess. The stopper 31 and the rearward end of the rod 10, each have aligned radial holes therethrough, with hole 31*a*, 31*b* in the stopper and hole 10*b* in the rod. A safety pin 29 extends in the aligned holes for attaching the stopper 31 and therefore the plug 25, to the rearward end of the rod 10. Pin 29 has a large diameter end 29*a* that sits in the large diameter part 31*a* of the hole in stopper 31, while a small diameter shank 29*b* of pin 29, extends in rod hole 10*b* and in a smaller diameter part 31*b* of the stopper hole. In this way the pin is well seated in the aligned holes and captured in the recess of plug 25 for use, yet can easily be pushed out of the aligned holes by a user using a drift pin or the like, to push the safety pin 29 in an opposite direction out of the aligned holes, to disassemble the buffer assembly.

As shown in FIG. 4, this is easily done by pushing the plug 25 forwardly to compress the springs 18 and 23 to expose the stopper 31 so the pin can be pushed out of the aligned holes 31*a*, 31*b* and 10*b*. This releases the plug 25 that can then be slide off the rod 10 alone with the other parts of the buffer assembly.

Stopper 31 is advantageously made of strong light polymer or metal similar to the material of buffer tube 21, or of other suitable material. Pin 29 if preferably of steel or likewise strong material.

As shown in FIG. 2, the central tube 12 extends partly into the buffer tube 21, buffer tube 21 having a stepped central bore with a recess for accommodating a rearward end of the central tube. The rearward end of counterweight spring 18 also extends into another larger diameter, forward portion of the buffer tube bore.

With reference to FIGS. 1 and 5, the cap 15 has a forward, large diameter flange 15*a* adapted to be received and to freely move in the receiver extension 110, and a small diameter collar 15*b* adapted to receive the forward end of the action spring 120 of the weapon. The buffer tube 21 has a large diameter flange 21*a* adapted to move in the action spring 120, and a small diameter collar 21*b* for receiving a forward end of the buffer spring 23. The shock absorbing plug 25 has a large diameter rear flange 25*a* adapted to move in the action spring 120, and a small diameter collar 25*b* for receiving a rearward end of the buffer spring 23. All parts of the buffer assembly except for the cap flange 15*a* that engages the end of the action spring 120, have outside diameters that are less than the inside diameter of the action spring so that they are easily accommodated within the action spring 120 to allow the buffer assembly to easily move in the receiver extension 110.

FIG. 3 illustrates another embodiment of the invention that differs from the embodiment of FIG. 1 only in having a central tube cap 17 with flat cord areas on its outer circumference to accommodate other weapon designs. FIG. 10 illustrates another embodiment of the invention that uses the same buffer assembly as that of FIG. 1 or 3, but that includes a spacer 26 for the longer received extension of an M16 style weapon 200 with fixed stock, so that the buffer assembly of the invention can be interchangeably used in weapons having differing received extension lengths. The forward face of spacer 26 acts like the rearward wall 130 of receiver extension 110 in this case.

In operation the buffer assembly of the invention functions as follows. Starting from the battery or rest position of FIG. 5, the weapon trigger is pulled to fire a round in the weapon chamber (not shown). This moves the bolt carrier 112 rearwardly during the start of the firing cycle, from its battery position in FIG. 5, to its full recoil position in FIG. 6. In this full recoil position, buffer tube 21, counterweight 16, central tube 12 with its cap 15 and washer 14, all move to their maximum rearward positions on rod 10, and compress the counterweight spring 18 fully and the buffer spring 23 fully or almost fully. In this full recoil position, the forward end of rod 10, extends into a central opening in the bolt carrier 112 since the rod 10 is axially fixed to the plug 25.

Figure 8:
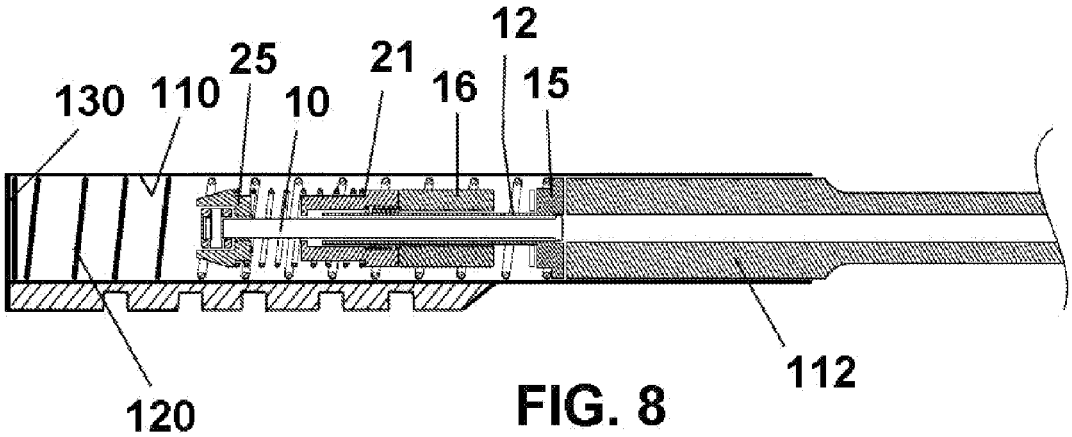
FIG. 8 is a view similar to FIG. 7, taken an instant after the position of FIG. 7, as the bolt carrier continues its return to the battery position.

An instant later, as shown in FIG. 7, the buffer tube 21 begins to rebound forwardly under the biasing force of its spring 23, and carries the counterweight 16 and the central tube 12 with cap 15 also forwardly. Since the counterweight spring 18 is weaker than the buffer spring 23, the counterweight 16 stays in a rearward position, against the forward face of the buffer tube 21 by inertia during this period, and does not yet move any closer to the washer 14 and cap 15. FIG. 8 shows the parts an instant after FIG. 7, when the bolt carrier 112 is further forward in the receiver extension 110, and the buffer spring 23 has fully or almost fully expanded to its rest position. At this time during the firing cycle the counterweight 16 is still holding its spring 18 fully or almost fully compressed due to its mass and inertia that have not yet been overcome.

FIG. 9 illustrates a subsequent instant of the firing cycle, just after FIG. 8, as the counterweight spring 18 partially expands to start pushing the counterweight 16 forwardly toward the washer 14. The cycle ends with the parts back in their FIG. 5 position, but only after the counterweight 16 has impacted the washer 14 and transmitted its momentum to the cap 15 and bolt carrier 112, and therefore to the rest of the weapon.

This staged inertial effect of the buffer assembly of the invention has been found to greatly improve the recoil characteristics of the weapon, in particular, automatic weapons during automatic firing mode. The buffer assembly also improves recoil characteristics for semi-automatic firing mode and for semi-automatic only weapons like the AR15. The ease with which the buffer assembly can be dissembled, and the interchangeability of the springs 18 and 23 for compression springs of different biasing characteristics, and of the counterweight 16 for counterweights of different masses, also allows the buffer assembly to be fine-tunes for a wide variety of weather and temperature conditions, and for shooting styles and preferences, and for ammunition types and conditions.

A great advantage of the invention is that by selecting the weight of the counterweight 16 and the compression force of the springs 18 and 23, a shooter can accurately tune the recoil of the weapon for climate and ammunition power. To further advance this feature the assembly is easily disassembled as explained above and the assembly is advantageously supplied to the user as a kit with multiple counterweights 16 each of a different weight, and multiple springs 18 and 23, each with different compression force characteristics. For example, three different weights 16, three different springs 18 and three different springs 23 may be provided with the kit that also includes one of each other parts of the assembly.

The kit may include a counterweight 16 of tungsten carbide weighing 70 grams, another of copper weighing 45 grams and a third of steel weighting 35 grams. If additional or different weights are found to be needed, for example, to tuning the firearm recoil for extremes like arctic or desert weather or very humid or very dry conditions or extremely powerful or extremely weak ammo, the diameter of the counterweight can be changed to obtain tungsten carbide counterweights of other weighted, such as 80, 65 and 45 grams.

A set of three counterweight springs 18 may also be provided, for example, with rest/load position forces per FIG. 2 of 0.35, 0.45 and 0.55 lbs., and fully compressed position forces per FIG. 6 of 0.66, 0.84 and 1.10 lbs. respectively. A set of three buffer springs 23 may also be provided, for example, with rest position forces per FIG. 2 of 1.65, 2.20 and 2.75 lbs., and fully compressed position forces per FIG. 6 of 5.50, 6.60 and 7.70 lbs. respectively.

Such a set of three counterweights 16, three springs 18 and three springs 23, gives the shooter 27 possible combinations for tuning the recoil to a desired level to accommodate weather conditions including a wide range of temperature and humidity conditions, ammo strengths from weak ammo to high powered ammo, and performance characteristics from high accuracy for competitive shooting to knock-down power for weaponry use. By structuring the buffer assembly as disclosed, the shooter can change the combination of counterweight 16 and springs 18 and 23 in seconds with minimal tools.

While specific embodiments of the invention have been shown and described in detail to illustrate the application of the principles of the invention, it will be understood that the invention may be embodied otherwise without departing from such principles.

What is claimed is:

1. A buffer assembly for moving in a receiver extension (110) of an automatic or semi-automatic firearm (100), against an action spring (120) in the receiver extension, from a forward battery position to a rearward recoil position, by action of a bolt carrier (112) movable at least partly into the receiver extension during the start of a firing cycle, the buffer assembly comprising:

a rod (10) having a forward end and a rearward end;

a central tube (12) mounted for movement between a forward position and a rearward position on the rod, the central tube having a cap (15) at its forward end against which the bolt carrier pushes during a firing cycle, the central tube being shorter than the rod so that the central tube may move along the rod between the forward and rearward positions of the central tube;

a shock absorbing plug (25) attached to a rearward end of the rod for engaging an end wall of the receiver extension during an intermediate part of a firing cycle;

a buffer tube (21) mounted for movement with the central tube and on the rod between a rearward position with a rearward end of the buffer tube near or against a forward face of the plug (25) during the intermediate part of the firing cycle, and a forward position spaced from the plug;

a buffer spring (23) engaged between the plug (25) and the buffer tube (21) for biasing the buffer tube toward its forward position;

a counterweight (16) mounted for movement on the central tube (12), between a rearward position toward the buffer tube (21) and a forward position toward the cap (15), for delaying the firing cycle;

a shock absorbing washer (14) on the central tube (12) between the counterweight (16) and the cap (15) for smoothing an impact between the counterweight and the cap at an end of a firing cycle; and a counterweight spring (18) that is weaker than the buffer spring (23), for biasing the counterweight (16) toward the cap (15).

2. The buffer assembly of claim 1, wherein the shock absorbing plug (25) includes a rearward recess, a stopper (31) in the recess, the stopper and the rearward end of the rod having aligned radial holes therethrough, and a safety pin (29) extending in the aligned holes for attaching the stopper (31) and the plug (25) to the rearward end of the rod.

3. The buffer assembly of claim 1, wherein the central tube (12) extending partly into the buffer tube (21).

4. The buffer assembly of claim 1, including at least one of: a plurality of counterweights (16) each of a different weight; a plurality of buffer springs (23) each of a different compression force; and a plurality of counterweight springs (18) each of a different compression force, whereby multiple combinations of one counterweight (16), one counterweight spring (18), and one buffer spring (23) can be selected for use in the buffer assembly to tune recoil of the firearm.

5. The buffer assembly of claim 1, wherein the buffer tube (21) is make of a rigid polymer.

6. The buffer assembly of claim 1, wherein the washer (14) is make of a flexible polymer.

7. The buffer assembly of claim 1, wherein the rod (10) has an enlarged forward end and the cap (15) has a recess for receiving the enlarged forward end and for retaining the cap on the forward end of the rod while permitting the cap (15), the central tube (12), the washer (14), the counterweight (16) and the buffer tube (21), to move rearwardly on the rod (10).

8. The buffer assembly of claim 1, wherein the rod (10), the tube (12) and the cap (15) are made of steel.

9. The buffer assembly of claim 1, wherein the cap (15) has a large diameter flange (15*a*) adapted to be received and to freely move in a receiver extension (110) and a small diameter collar (15*b*) adapted to receive the forward end of an action spring (120).

10. The buffer assembly of claim 1, wherein the buffer tube (21) has a large diameter flange (21*a*) adapted to move in an action spring (120) and a small diameter collar (21*b*) for receiving a forward end of the buffer spring (23).

11. The buffer assembly of claim 1, wherein the shock absorbing plug (25) has a large diameter rear portion flange (25*a*) adapted to move in an action spring (120) and a small diameter collar (25*b*) for receiving a rearward end of the buffer spring (23).

12. The buffer assembly of claim 1, wherein the buffer tube (21) has a forward recess for receiving a portion of the counterweight spring (18).

13. A buffer assembly comprising:

a rod (10) having a forward end and a rearward end;

a cap (15) having a forward end against which a bolt carrier pushes during a firing cycle, the cap being movable along the rod between forward and rearward positions;

a shock absorbing plug (25) attached to a rearward end of the rod for engaging an end wall of a receiver extension during an intermediate part of the firing cycle;

a buffer tube (21) mounted for movement on the rod between a rearward position toward the plug (25) during the intermediate part of the firing cycle, and a forward position spaced from the plug;

a buffer spring (23) engaged between the plug (25) and the buffer tube (21) for biasing the buffer tube toward its forward position;

a counterweight (16) mounted for movement on the rod, between a rearward position toward the buffer tube (21) and a forward position toward the cap (15), for delaying the firing cycle;

a shock absorbing washer (14) between the counterweight (16) and the cap (15) for smoothing an impact between the counterweight and the cap at an end of the firing cycle; and a counterweight spring (18) that is weaker than the buffer spring (23), for biasing the counterweight (16) toward the cap (15).

14. The buffer assembly of claim 13, wherein the shock absorbing plug (25) includes a rearward recess, a stopper (31) in the recess, the stopper and the rearward end of the rod having aligned radial holes therethrough, and a safety pin (29) extending in the aligned holes for attaching the stopper (31) and the plug (25) to the rearward end of the rod.

15. The buffer assembly of claim 13, including the central tube (12) connected to a rearward side of the cap (15) and extending partly into the buffer tube (21).

16. The buffer assembly of claim 13, including at least one of: a plurality of counterweights (16) each of a different weight, a plurality of buffer springs (23) each of a different compression force, and a plurality of counterweight springs (18) each of a different compression force, whereby multiple combinations of one counterweight (16), one counterweight spring (18), and one buffer spring (23) can be selected to tune recoil of the firearm.

17. The buffer assembly of claim 13, wherein the buffer tube (21) is make of a rigid polymer.

18. The buffer assembly of claim 13, wherein the washer (14) is make of a flexible polymer.

19. The buffer assembly of claim 13, wherein the rod (10) has an enlarged forward end and the cap (15) has a recess for receiving the enlarged forward end and for retaining the cap on the forward end of the rod while permitting the cap (15), the washer (14), the counterweight (16) and the buffer tube (21), to move rearwardly on the rod (10).

20. The buffer assembly of claim 13, wherein the rod (10) and the cap (15) are made of steel.

* * * * *